United States Patent [19]

Walker

[11] 4,117,660

[45] Oct. 3, 1978

[54] CASING RING FOR WATCH MOVEMENT

[75] Inventor: Erich Walker, Orvin, Switzerland

[73] Assignee: Bulova Watch Company, Inc., Flushing, N.Y.

[21] Appl. No.: 761,962

[22] Filed: Jan. 24, 1977

[30] Foreign Application Priority Data

Feb. 12, 1976 [CH] Switzerland ..... 1695/76

[51] Int. Cl.[2] ..... G04B 37/00

[52] U.S. Cl. ..... 58/23 R; 58/88 R

[58] Field of Search ..... 58/23 R, 23 BA, 50 R, 58/57, 88 R, 88 B, 90 B

[56] References Cited

U.S. PATENT DOCUMENTS

| | | | |
|---|---|---|---|
| 3,911,663 | 10/1975 | Kern et al. | 58/23 BA |
| 3,945,196 | 3/1976 | Wood et al. | 58/50 R |
| 3,992,870 | 11/1976 | Dekel | 58/23 BA |
| 4,051,665 | 10/1977 | Arn | 58/50 R |

*Primary Examiner*—B. Dobeck
*Assistant Examiner*—Vit W. Miska
*Attorney, Agent, or Firm*—Michael Ebert

[57] ABSTRACT

A casing ring adapted to encircle a watch movement having an external diameter that is smaller than the internal diameter of the case into which it is to be fitted, the ring serving to effectively magnify the movement diameter so that it substantially matches that of the case. The case is provided with an actuating member intended to cooperate with an operating element, such as an electrical switch, incorporated in the movement to carry out a setting or other operating function. The portion of the casing ring interposed between the actuating member and the operating element is swingable to function as an intermediate link therebetween for transmitting the motion of the member to the element.

5 Claims, 5 Drawing Figures

CASING RING FOR WATCH MOVEMENT

BACKGROUND OF INVENTION

The present invention relates generally to ring casings for watches, and more particularly to a casing ring adapted to encircle a watch movement which is to be fitted into a case, the ring serving to reconcile the dimensions of the movement to those of the case.

In the mass-production of watches, it is not practical to provide movements and cases therefor having matching diameters. Thus it may be necessary with a watch movement of a given external diameter, to fit this movement into a case having a larger internal diameter. Or the same movement may have to be fitted into a family of cases having different internal diameters, all of which are greater than the external diameter of the movement. In other instances, it may be necessary to fit movements of different external diameter in cases all having the same internal diameter.

In order to reconcile the difference between the external diameter of the movement and the internal diameter of the case in which it is to be installed, it is known to provide a casing or magnifying ring which encircles the movement and imparts to the movement an effective external diameter which substantially matches the internal diameter of the related case.

Such casing rings are useful; for they serve to simplify manufacturing procedures and make it unnecessary to maintain a large inventory of matching movements and watch cases. The configuration of such casing rings must also take into account that the movements and the watch cases are not all in circular form; for in many instances, they have oval or other shapes.

The difficulty encountered with existing types of casing rings is that many watch cases incorporate push buttons and other types of driving or adjustment means which function as actuating members that cooperate with mechanical stop devices, electrical switches, or other operating elements included in the movement.

For example, with a watch case provided with one or more push buttons, in order to operatively link the push button or other actuating member to the operating element in the watch to transmit the motion of the actuating member thereto, it is necessary with existing types of casing rings to provide the button with a push pin of an appropriate length sufficient to pass through the casing ring and engage the operating element. Not only does this requirement complicate manufacturing procedures and add to the cost of production, but it is particularly disadvantageous in those watch movement structures which have projecting dials that can only be fitted into cases by means of special expedients.

It is also known with existing types of casing rings to transmit the motion of the actuating member or push pin mounted in the case to the related operating element in the movement by means of an auxiliary sliding pin which is not secured to the push pin. This approach brings into play other technical problems, and it is not economical; for then it becomes necessary to provide an inventory of auxiliary slide pins of different lengths.

SUMMARY OF INVENTION

In view of the foregoing, it is the main object of this invention to provide a casing ring which obviates the drawbacks of existing types of rings and makes it possible to operatively interlink a push-button or other actuating member mounted in the watch case to an operating element in the movement fitted therein without the use of auxiliary pins or other expedients.

More particularly, it is an object of the invention to provide a casing ring for a watch movement which serves to reconcile the case and movement dimensions and also functions as an intermediate operating link between an actuating member mounted in the case and an operating element included in the movement.

Briefly stated, these objects are attained in a casing ring which encircles a watch movement having an external diameter which is smaller than the internal diameter of the case in which it is to be fitted, the ring serving to effectively magnify the external diameter of the movement so that it substantially matches the internal diameter of the case.

The case is provided with an actuating member which is intended to cooperate with an operating element in the movement to carry out a setting or other operating function. The portion of the ring interposed between the actuating member in the case and the operating element in the movement is swingable in the direction of the principal plane of the ring and functions as an intermediate link therebetween to transmit the motion of the actuating member to the operating element.

OUTLINE OF DRAWINGS

For a better understanding of the invention as well as other objects and further features thereof, reference is made to the following detailed description to be read in conjunction with the accompanying drawings, wherein.

DESCRIPTION OF INVENTION

First Embodiment

Figure 1:
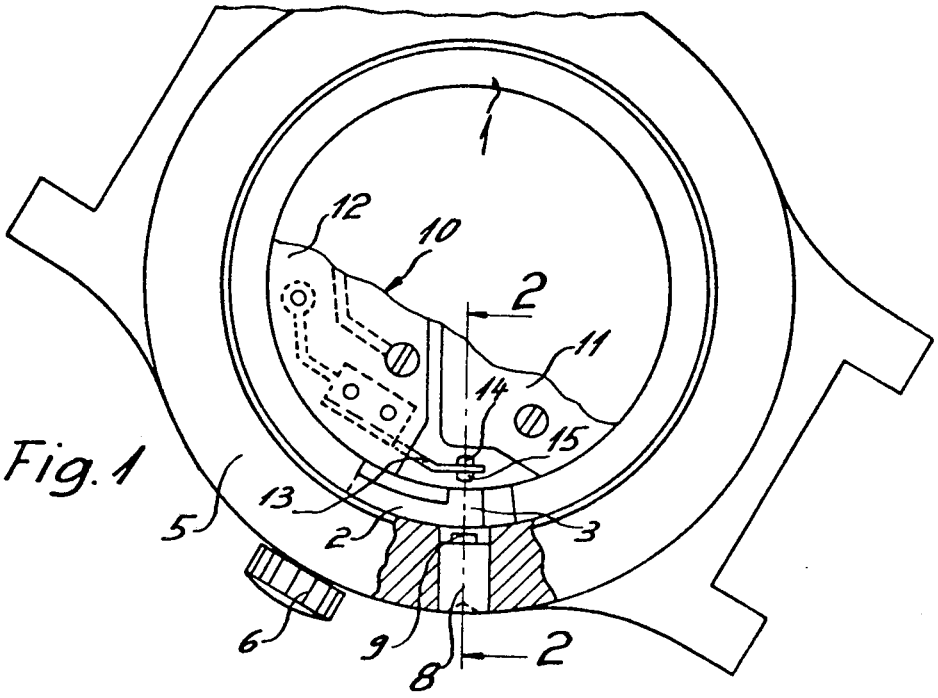
FIG. 1 is a back view, partly cut away, of an opened wristwatch case within which is installed a movement and a casing ring, in accordance with one embodiment of the invention.
Figure 3:
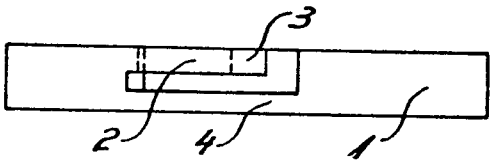
FIG. 3 is a front elevational view of the first embodiment of the casing ring.
Figure 2:
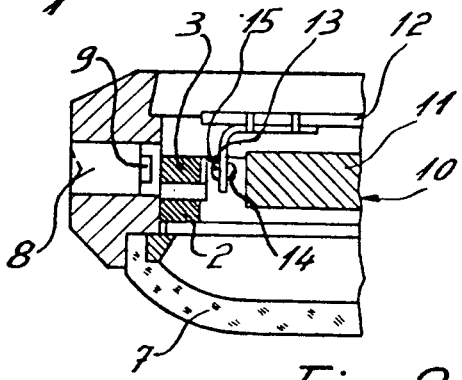
FIG. 2 is a transverse section taken in the plane indicated by line 2–2 in FIG. 1.

Referring now to FIGS. 1, 2 and 3, there is shown a casing ring in accordance with the invention, generally identified by numeral 1. Ring 1, which is made of synthetic plastic material, encircles an electronic watch movement 10 and serves to magnify the effective external diameter of this movement so that it substantially matches the internal diameter of the watch case into which the movement is inserted. While an electronic watch is shown, the invention is also fully applicable to the movement of a mechanical watch.

As is evident from FIGS. 1 and 2, movement 10 has an external diameter smaller than the internal diameter of watch case 5, the casing ring 1 interposed therebetween serving to stabilize the position of the movement within the case. The front face of the movement is covered by a glass crystal 7. Crown 6, shown in FIG. 1, may have several functions; and among other functions, it serves to set the watch.

The watch movement includes an operating element to close an electrical circuit, this element being constituted by a flat metal spring 13 anchored to and extending from an insulating plate 12. The free end of spring 13 carries on its inner side a contact piece 14, such that when spring 13 is inwardly deflected, it engages and makes electrical contact with a metal base plate 11 to cause a switching action. The anchored end of spring 13 is connected to a conductive printed circuit on insulating plate 12. The free end of spring 13 on the outer side directly opposite contact piece 14 carries a push piece 15 formed of insulating material.

Inserted in a bore drilled in case 5 is a cylindrical sleeve 8 having a press button 9 therein. Means are provided (not shown) to spring bias button 9 so that it normally occupies the inactive position shown in FIG. 1. When press button 9 is depressed by means of a ball-point pen or similar means, the head of the button then acts in a manner, to be later explained, to deflect spring 13 to cause contact piece 14 to engage metal base plate 11 to carry out a setting or some other function. Thus the switch action may be used to correct for a small deviation in the seconds hand position.

In order to transmit the motion from the head of press button 9, which lies adjacent the inner wall of watch case 5, to the push piece 15 on deflectable spring 13, the portion of casing ring 1 interposed between press button 9 and push piece 15 is provided with a flexible tongue 2. This tongue is swingable in the direction of the principal plane of ring 1.

Tongue 2 is defined by an L-shaped cut in the body of casing ring 1, the cut creating a ring bridge 4 of reduced height below tongue 2. As best seen in FIG. 1, tongue 2 is thinner than the body of casing ring 1 to enhance its flexibility, except for the relatively thick free end of the tongue which forms a push pad 3.

Push pad 3 lies between the head of press button 9 and push piece 15 on spring 13 and serves as an intermediate link therebetween. When, therefore, press button 9 is pressed inwardly, this motion is transmitted by push pad 3 to push piece 15 to deflect spring 13 and to effect the desired switch closure.

Thus casing ring 1 not only carries out its usual function to reconcile the different diameters of the movement and of the case in which it is installed, but it also acts as an intermediate link between an actuating member mounted in the case and an operating element included in the movement, thereby obviating the need for auxiliary pins or other special linkage means which complicate assembly operations.

Second Embodiment

Figure 4:
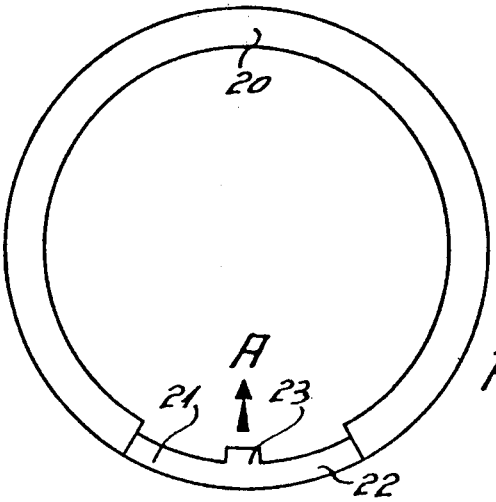
FIG. 4 is a plan view of a second embodiment of a casing ring in accordance with the invention.
Figure 5:
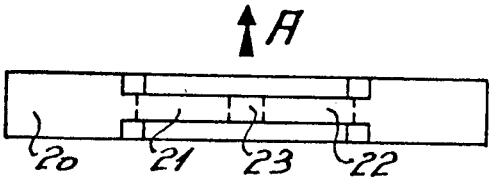
FIG. 5 is a front elevational view of the second embodiment of the casing ring.

In casing ring 20 shown in FIGS. 4 and 5, the intermediate link formed in a portion of this ring to transmit the motion of a press button or other actuating member in the direction indicated by arrow A to an operating element in a movement encircled by the ring is defined by upper and lower cuts in the ring which create a pair of longitudinally-extending arms 21 and 22 of reduced thickness, whose ends are joined by a relatively thick push pad 23.

Because arms 21 and 22 are substantially thinner than the body of the ring, these arms are flexible, making it possible to swing push pad 23 in the direction A, which is the direction of the principal plane of the ring. This push pad serves the same intermediate link function as push pad 3 in the first embodiment. Arms 21 and 22 and pad 23 are integral with body ring 1, to provide a low-cost, one-piece ring.

While there have been shown and described preferred embodiments of a casing ring for a watch in accordance with the invention, it will be appreciated that many changes and modifications may be made therein without, however, departing from the essential spirit thereof.

I claim:

1. A casing ring formed of synthetic plastic material adapted to encircle a watch movement having an external diameter that is smaller than the internal diameter of a watch case into which the movement is to be fitted, the ring serving to effectively magnify the movement diameter so that it substantially matches that of the case, said case having an actuating member mounted therein which is inwardly movable and is intended to cooperate within an operating element included in the movement for carrying out an operating function, said member being constituted by a press-button which is biased to normally assume an inactive position, the portion of said ring interposed between said actuating member and said operating element being formed into a swingable intermediate link deflectable by the press-button when it is actuated to assume an active position to transmit the motion thereof to said operating element, said operating element being constituted by an electrical switch having normally-disengaged contacts, said link having a push pad integral therewith whose position is such that when said link is deflected by the press-button, the pad then pushes said contacts into engagement.

2. A ring as set forth in claim 1, wherein said link portion is defined by two relatively thin and flexible arms whose ends are joined to a thicker push pad which is engageable by the actuating member to push the operating element.

3. A ring as set forth in claim 1, wherein said swingable link is integral with the body of the ring.

4. A ring as set forth in claim 1, wherein said link portion of the ring is constituted by a flexible tongue.

5. A ring as set forth in claim 4, wherein said tongue is of reduced thickness relative to the thickness of the body of the ring, save at the free end of the tongue which defines said push pad.

* * * * *